US009045955B2

(12) United States Patent
Ledgerwood, III

(10) Patent No.: US 9,045,955 B2
(45) Date of Patent: Jun. 2, 2015

(54) DETRITUS FLOW MANAGEMENT FEATURES FOR DRAG BIT CUTTERS AND BITS SO EQUIPPED

(75) Inventor: Leroy W. Ledgerwood, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/197,554

(22) Filed: Aug. 3, 2011

(65) Prior Publication Data

US 2011/0297452 A1 Dec. 8, 2011

Related U.S. Application Data

(62) Division of application No. 11/606,611, filed on Nov. 29, 2006, now Pat. No. 8,025,113.

(51) Int. Cl.

| | |
|---|---|
| ***E21B 10/573*** | (2006.01) |
| ***E21B 10/52*** | (2006.01) |
| ***E21B 10/54*** | (2006.01) |

(52) U.S. Cl.

CPC ..... *E21B 10/573* (2013.01); *E21B 10/54* (2013.01)

(58) Field of Classification Search

CPC ..... E21B 10/46; E21B 10/52; E21B 10/573
USPC ..... 175/432, 428
See application file for complete search history.

(56) References Cited

U.S. PATENT DOCUMENTS

| | | | | |
|---|---|---|---|---|
| 4,749,052 A | | 6/1988 | Dennis | |
| 4,823,892 A | | 4/1989 | Fuller | |
| 4,852,671 A | | 8/1989 | Southland | |
| 4,919,220 A | | 4/1990 | Fuller et al. | |
| 5,351,770 A | * | 10/1994 | Cawthorne et al. | 175/374 |
| 5,425,288 A | | 6/1995 | Evans | |

(Continued)

FOREIGN PATENT DOCUMENTS

| | | |
|---|---|---|
| BE | 1012119 | 5/2000 |
| EP | 1188898 | 3/2002 |
| GB | 2174740 | 11/1986 |

OTHER PUBLICATIONS

PCT International Search Report for PCT/US2007/024574, mailed Apr. 23, 2008.

(Continued)

*Primary Examiner* — Catherine Loikith
(74) *Attorney, Agent, or Firm* — TraskBritt

(57) ABSTRACT

Rock detritus created by a drag bit cutter shearing subterranean formation material may flow under the cutter and attach itself to the side surface of the cutter barrel by differential pressure-induced sticking, and dilate. This attached material, confined by hydrostatic pressure, can create and strengthen a barrier between the cutter and the virgin rock being cut. The detritus barrier absorbs bit weight and reduces cutter efficiency by impairing contact of the cutter with the virgin rock formation. Increasing friction between the rock detritus and a side surface of the cutter barrel inhibits detritus flow, reduces build up, and allows hydrostatic pressure to contribute to, rather than inhibit, the cutting process. Similar beneficial results may be obtained when hydrostatic pressure drilling fluid is permitted to communicate through holes in the side surface of the cutter, or through an otherwise permeable side surface alleviating detritus sticking due to differential pressure effects.

20 Claims, 5 Drawing Sheets

(56) References Cited

U.S. PATENT DOCUMENTS

| | | | | |
|---|---|---|---|---|
| 5,499,688 | A | 3/1996 | Dennis | |
| 5,590,729 | A | 1/1997 | Cooley et al. | |
| 5,667,028 | A * | 9/1997 | Truax et al. | 175/428 |
| 5,947,216 | A | 9/1999 | Truax et al. | |
| 6,068,072 | A | 5/2000 | Besson et al. | |
| 6,216,805 | B1 * | 4/2001 | Lays et al. | 175/374 |
| 6,272,753 | B2 | 8/2001 | Packer | |
| 6,510,910 | B2 | 1/2003 | Eyre et al. | |
| 6,779,613 | B2 | 8/2004 | Dykstra et al. | |
| 7,316,279 | B2 | 1/2008 | Wiseman et al. | |
| 2002/0108790 | A1 | 8/2002 | Eyre et al. | |
| 2003/0019333 | A1 | 1/2003 | Scott | |
| 2007/0278017 | A1 | 12/2007 | Shen et al. | |

OTHER PUBLICATIONS

Examination Report issued by the European Patent Office for Application No. 07 862 327.9, dated Oct. 1, 2009, 5 pages.

Written Opinion of the International Searching Authority for International Application No. PCT/US2007/024574, mailed Apr. 23, 2008, 6 pages.

* cited by examiner

DETRITUS FLOW MANAGEMENT FEATURES FOR DRAG BIT CUTTERS AND BITS SO EQUIPPED

CROSS-REFERENCE TO RELATED APPLICATION

This application is a divisional of U.S. patent application Ser. No. 11/606,611, filed Nov. 29, 2006, now U.S. Pat. No. 8,025,113, issued Sep. 27, 2011, the disclosure of which is hereby incorporated herein by this reference in its entirety.

FIELD OF THE INVENTION

This invention relates generally to drill bits for drilling subterranean formations and, more specifically, to cutters for drilling such formations and drill bits so equipped.

BACKGROUND OF THE INVENTION

Rotary drag bits have been used for subterranean drilling for many decades, and various sizes, shapes, and patterns of natural and synthetic diamonds have been used on drag bit crowns as cutting elements, or cutters. When drilling certain subterranean formations, a properly designed drag bit can provide an improved rate-of-penetration (ROP) over a tri-cone bit.

Rotary drag bit performance has been improved significantly with the introduction of polycrystalline diamond compact (PDC) cutting elements, usually configured with a substantially planar PDC table formed onto a cemented tungsten carbide substrate under high-temperature and high-pressure conditions. PDC tables are formed into various shapes, including circular, semicircular, and tombstone, which are the most commonly used configurations. Additionally, the PDC tables can be formed so that a peripheral edge, or edge portion, of the table is coextensive with the sidewall of the supporting tungsten carbide substrate, or the PDC table may overhang the substrate sidewall slightly, forming a "lip" at the trailing edge of the table. In some instances, such as when a portion of the PDC table adjacent the cutting face has been leached of the metal catalyst used to stimulate diamond-to-diamond bonding during formation of the PDC table, a lip may form during drilling due to more rapid wear of the unleached portion of the PDC table to the rear of the leached portion. PDC cutters have provided drill bit designers with a wide variety of potential cutter deployments and orientations, crown configurations, nozzle placements and other design alternatives not possible with natural diamond or smaller synthetic diamond cutters.

While rotary drag bits provide better ROP than tri-cone bits under many conditions, the performance of rotary drag bits can still be improved. Researchers in the industry have recognized that controlling buildup of recompacted rock cuttings, or detritus, on the cutting face of a PDC cutter is a significant factor affecting cutting performance. Methods used to manage detritus buildup on PDC table cutting faces include mechanical, hydraulic and chemical means of attacking the recompacted detritus.

The aforementioned lip configuration on PDC cutting elements has been observed to improve cutting efficiency by reducing detritus buildup on the sidewall of the cutting element to the rear of the PDC table, but the operative mechanism for this observed phenomenon has not been understood. Moreover, configuring a PDC cutting element with, or to form, a protruding lip adds cost to cutting element fabrication and the increased cost of such cutting elements may not be perceived to be commensurate with the benefits obtained for many applications.

What is needed are straightforward, cost-effective improvements to rotary drag bit cutters to inhibit flow and buildup of detritus over the side surface of the cutter adjacent the formation being cut, to remove recompacted detritus from the side surface of the cutter earlier in the buildup cycle, or both.

BRIEF SUMMARY OF THE INVENTION

Embodiments of the invention demonstrate that modifications to the structure of PDC cutting elements or cutters, such as varying the topography of the side surface of the cutter barrel or increasing its permeability at least in an area adjacent the formation being cut, can achieve beneficial results by inhibiting the flow and buildup of detritus on the side surface, or by effectively removing detritus buildup.

These structural configurations appear to counteract "differential sticking," which may be described as the tendency of detritus cut from the formation that flows past a cutter, between the cutter and the adjacent formation, to adhere to the surface of the cutter due to hydrostatic pressure acting on the detritus. Such differential sticking is avoided because these structural configurations of the cutter barrel enable hydrostatic pressure to invade between the side surface and any closely proximate detritus.

Embodiments of the invention include various structures to provide a varying topography for the side surface of the cutter barrel.

One approach to providing a varying side surface topography comprises texturing or roughening the side surface of the cutter barrel. A texture can be cast, milled, or cut into the side surface and may comprise ridges, grooves, cross-hatching, bumps, divots, dimples or holes. Roughening can be accomplished with sandblasting, beadblasting, shot-peening, or by adding hardfacing to the side surface by welding techniques.

Another approach to varying side surface topography may include adding structures to the side surface. It is contemplated that bars, discs, triangles, cubes, rods or balls formed from a wear-resistant material such as tungsten carbide, PDC elements, TSP (thermally stable PDC) elements, or a combination of such materials may be used. The structures, depending upon their composition, may be welded, brazed or cemented directly to the side surface or to compatible sockets formed in the side surface.

As yet another approach, particles of a wear-resistant material such as tungsten carbide, natural diamond or synthetic diamond may be applied to, or included in, the material used to form the side surface of the cutter barrel, or incorporated in an insert secured in a recess in the side surface.

In all of the foregoing cases, the varying side surface topography promotes access of ambient hydrostatic drilling fluid pressure in the vicinity of the cutter barrel to the side surface and specifically between detritus closely proximate the side surface and the side surface itself, which prevents differential sticking of detritus flowing past the side surface of the cutter barrel.

A further approach to effectively reduce the amount of detritus buildup on the side surface of the cutter barrel is to increase the permeability of the side surface to permit the ambient hydrostatic drilling fluid pressure in the vicinity of the cutter to communicate through the side surface to the area between the side surface and any detritus in close proximity, and prevent differential sticking.

The permeability can be improved by establishing a pattern of holes or apertures on the side surface of the cutter barrel or by forming the side surface of the cutter barrel from a porous, or permeable, material. The holes or porous material place the side surface of the cutter barrel in the vicinity of the formation in communication with the drilling fluid filtrate under hydrostatic pressure. Thus, the drilling fluid adjacent the side surface of the cutter barrel will lubricate the side surface and offset any tendency of the hydrostatic pressure adjacent the side surface to cause differential sticking. Since the hydrostatic pressure in the vicinity of the side surface of the cutter barrel is substantially equalized on the cutter side and the formation side of any detritus contacting the cutter barrel, the flow of drilling fluid (or the rotation of the bit moving through the drilling fluid) will break away any cut formation material stuck on, or compressed to, the side surface earlier in a detritus buildup cycle.

BRIEF DESCRIPTION OF THE SEVERAL VIEWS OF THE DRAWINGS

The foregoing and other advantages of the invention will become apparent upon reading the following detailed description with reference to the drawings, in which.

DETAILED DESCRIPTION OF THE INVENTION

It has been found that the recompacted rock detritus can have a confined strength on the same order of magnitude as virgin rock, and Particle Flow Code (PFC) models used in Discrete Element Modeling (DEM) of rock formations show that most of the energy in rock cutting using a fixed cutter is expended while extruding the recompacted detritus. Particle Flow Code is produced by Itasca Consulting Group, Inc., of Minneapolis, Minn.

Additionally, PFC models show that the flow of detritus under the cutter (between the cutter and the formation being cut) is equally as important as the flow of detritus on the cutter face. This role of detritus flow affecting the cutting mechanism, and the consequent potential for differential sticking to the cutter barrel, which impairs cutter access to the formation being drilled and significantly reduces cutting efficiency, has previously gone unrecognized in the art. Innovations that affect the flow of detritus under the cutter offer opportunity to enhance cutting efficiency.

When detritus material flows adjacent to a surface of a cutting element or cutter, it can differentially stick to the surface; this is true both of the recompacted cuttings or chips flowing on the cutting face of the cutter and those flowing under the cutter and across the side surface of the cutter barrel adjacent to the formation being cut. Particle Flow Code (PFC) models of rock characteristics show that the differential sticking of detritus material flowing under a cutter can be a significant factor governing cutting efficiency in certain subterranean formations and, perhaps, the single most significant factor in relatively impermeable formations such as all shales, and most carbonates. In such formations, where both the rock and the detritus are relatively impermeable, this recompacted particulate material creates a barrier between the cutter and the virgin rock. Downhole pressure compacts and strengthens the detritus material into the barrier, causing it to absorb bit weight and reduce cutter efficiency.

The pore pressure inside the detritus is typically lower than the hydrostatic pressure of the surrounding drilling fluid, because of dilation of the detritus, so the hydrostatic pressure pushes the detritus against the side surface of the cutter barrel. The nature of drilling fluid, or "mud," prevents penetration of the fluid into the particulate detritus mass, initiating and exacerbating this problem.

Figure 1A:
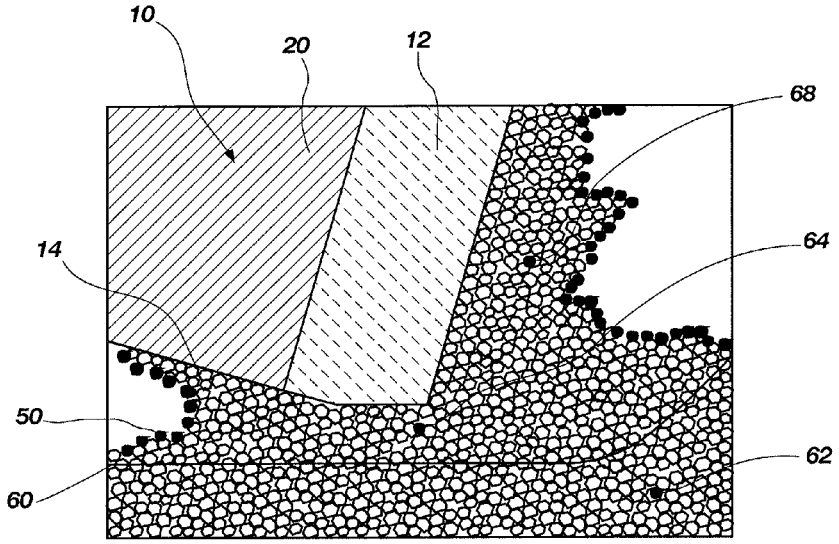
FIG. 1A is a Particle Flow Code (PFC) model of a cutter barrel assembly with detritus buildup on the bottom surface.
Figure 1B:
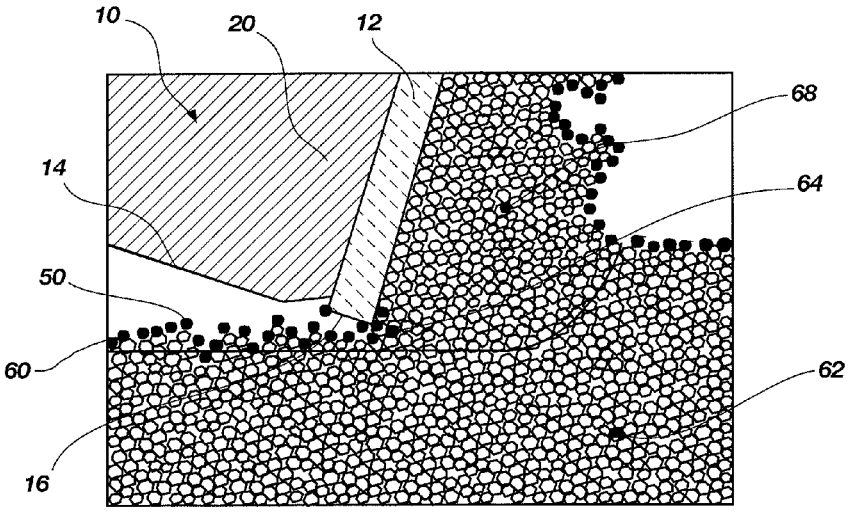
FIG. 1B is a PFC model of a cutter barrel assembly with a cutter including a lip and no detritus buildup on the bottom surface.

FIGS. 1A and 1B show PFC models of a PDC cutter 10 cutting rock. As shown, the bit body carrying the PDC cutter 10 comprising a tungsten carbide substrate 20 having a diamond table 12 formed thereon is traveling in a left to right direction, cutting into virgin rock 62 (below line 60), shearing the rock and forming detritus 64. A portion of the detritus 64 is extruded up the cutting face of diamond table 12 of the PDC cutter 10, forming a cuttings chip 68. In each of FIGS. 1A and 1B, some detritus 64 flows under the cutter 10. The black dots at the surface of the detritus 64 on the cutting face and under the PDC cutter 10 as well as on the surface of the virgin rock 62 represent a pressure boundary between, respectively, the detritus 64 and rock 62 and the surrounding drilling fluid pumped into the borehole and under hydrostatic pressure. In FIG. 1A, the detritus 64 flowing under the cutter 10 is differentially sticking to the side surface 14 of the cutter 10 and inhibiting cutting. In contrast, FIG. 1B includes a diamond table 12 that overhangs or forms a lip 16 beyond the adjacent surface of the tungsten carbide substrate 20. In this model very little detritus 64 flows under the cutter 10 and no detritus 64 is sticking to the side surface 14. This beneficial effect is attributed to the ability of the lip 16 to inhibit the flow of detritus 64. A clear side surface 14 allows the hydrostatic pressure to penetrate the detritus 64 at the lip 16 of diamond table 12, contributing to the efficiency of the cutting process.

Additionally, when detritus flows under a cutter during drilling, the degree of sticking of detritus to the cutter barrel has been observed to effect a clearing mechanism under appropriate circumstances. Initially, the detritus will form a deposit that continues to gather material until the buildup is large enough and configured in a shape that allows ambient hydrostatic pressure between the detritus and the side surface of the cutter barrel and alleviate differential sticking. As the cutter advances under these circumstances, the material buildup is sheared away from the side surface of the cutter barrel, temporarily enhancing cutting efficiency.

Figure 2A:
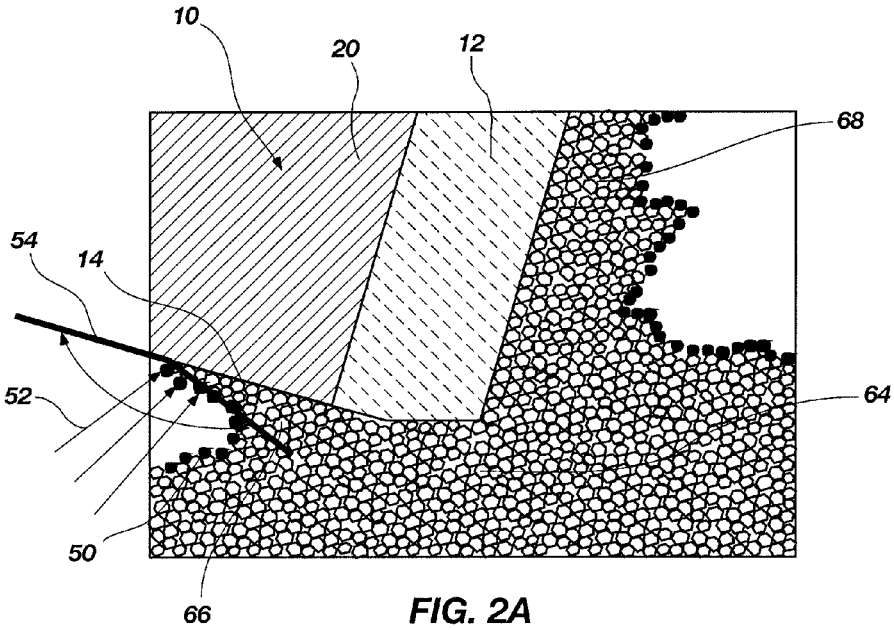
FIG. 2A is a PFC model of a cutter barrel assembly with detritus forming an obtuse angle between a bottom surface and a pressure boundary of compacted detritus.
Figure 2B:
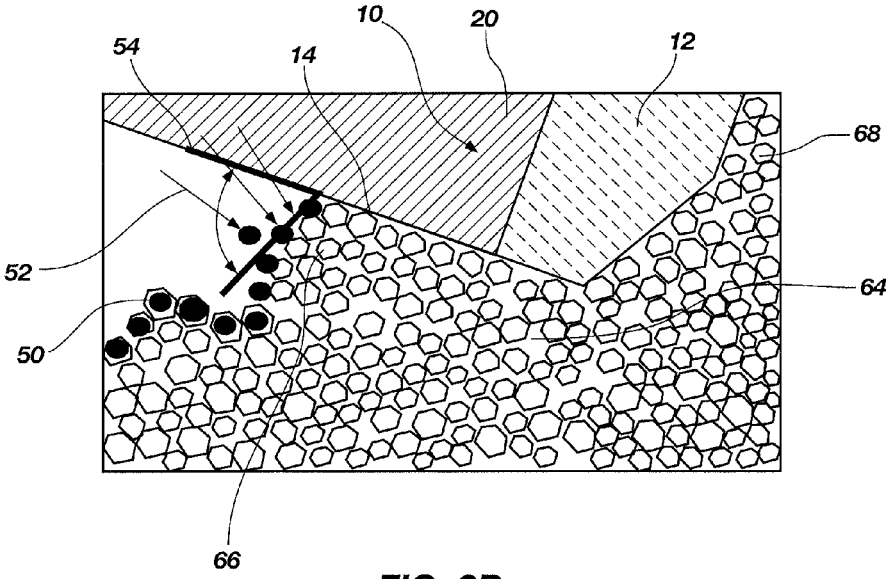
FIG. 2B is a PFC model of a cutter barrel assembly with detritus forming an acute angle between a bottom surface and a pressure boundary of compacted detritus.

Each of FIGS. 2A and 2B show a cutter 10 moving from the left toward the right with the diamond table 12 forming a cuttings chip 68. The detritus 64 is shown to be flowing under the cutter 1210 in both instances. However, the image of FIG. 2A depicts an undesirable situation in terms of the buildup of detritus 64. As the detritus 64 flows under cutter 10, it begins to differentially stick due to hydrostatic pressure pushing it against side surface 14, forming a compacted mass 66 on the side surface 14. The compacted mass 66 creates an obtuse angle 54 with the side surface 14. In this detritus configuration, the hydrostatic pressure (shown as vectors by arrows 52), which acts perpendicular to the pressure boundary 50, forces and holds the compacted mass 66 against the side surface 14. However, as shown in FIG. 2B, if movement of the detritus 64 adjacent side surface 14 is arrested, rather than the detritus 64 being permitted to slide on, stick to, and be compacted on, side surface 14, the angle 54 between the compacted mass 66 and the side surface 14 becomes acute, as shown in FIG. 2B. Once the detritus forms an acute angle 54 with side surface 14, the hydrostatic pressure 52 along pressure boundary 50 wedges between and forces any compacted mass 66 away from the side surface 14, releasing the differential pressure-initiated bond between the detritus 64 and the side surface 14 of cutter 10. As the total mass flow of detritus 64 past the cutter 10 continues during the drilling process, if the detritus 64 cannot slip easily along side surface 14, then the detritus 64 will form the aforementioned acute angle 54 with side surface 14 and hydrostatic pressure will continue its beneficial penetration into the region between the side surface 14 and the detritus 64, wedging and spreading the gap therebetween on a substantially continuous basis.

Figure 3A:
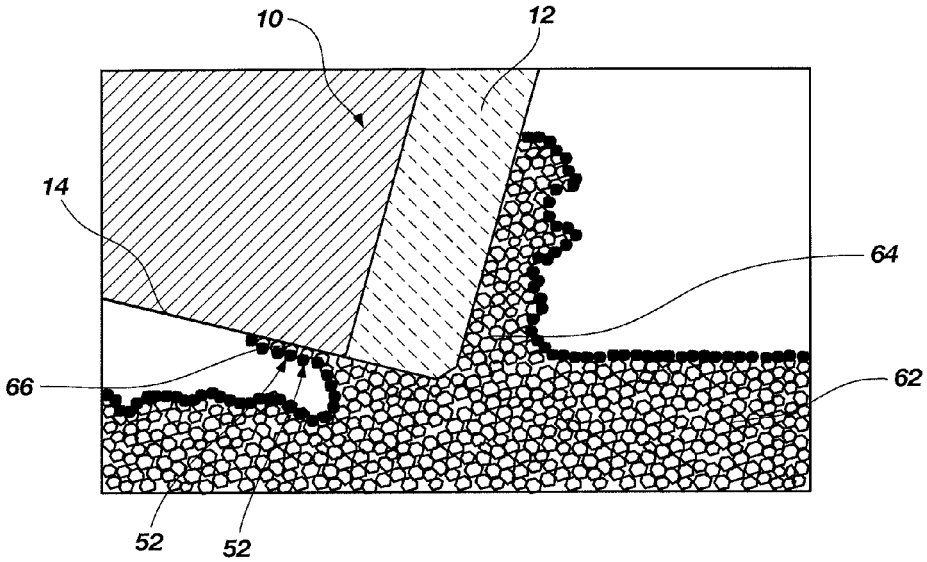
FIG. 3A is a PFC model of a cutter barrel assembly where the coefficient of friction for a bottom surface is low.
Figure 3B:
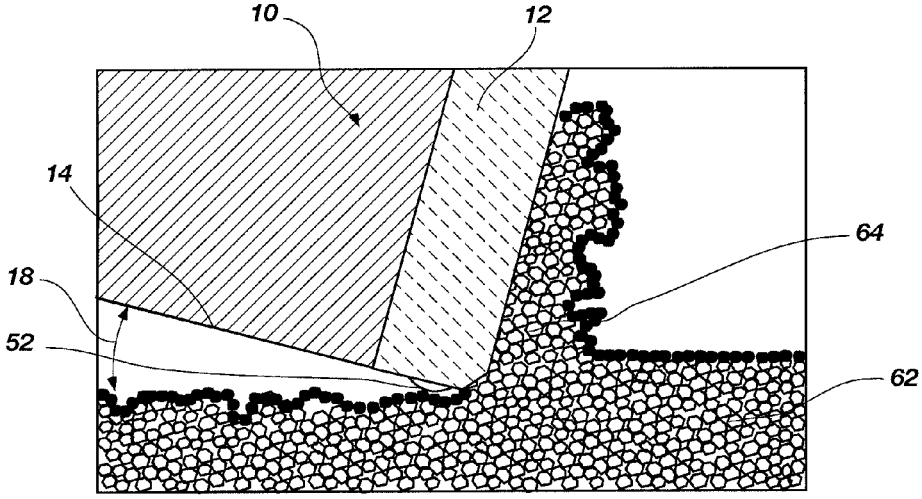
FIG. 3B is PFC model of a cutter barrel assembly where the coefficient of friction for a bottom surface is high.

It is common in the drilling industry to polish cutting faces of PDC cutters to attempt to limit detritus buildup by providing a low-friction surface on which the detritus, forming a cuttings chip, may easily side. However, PFC models show that, contrary to conventional thinking, higher coefficients of friction may be used to inhibit detritus buildup on cutter barrels. FIGS. 3A and 3B are PFC models showing cutters 10 where the friction coefficient of the side surface 14 has been manipulated. For the model shown in FIG. 3A, the coefficient is set arbitrarily low (0.1) and for the model in FIG. 3B the coefficient is set arbitrarily high (2.0). In FIG. 3A, the detritus 64 is shown to be flowing under the side surface 14 of cutter 10 and differentially sticking, forming a compacted mass 66 on the side surface 14. This compacted mass 66 of detritus 64 absorbs bit weight and enables the hydrostatic pressure 52 to continue buildup of detritus 64. In contrast, the PFC model with a high coefficient of friction shown in FIG. 3B shows no differential sticking. This allows the cutting edge of diamond table 12 to substantially fully contact the virgin rock 62 and the hydrostatic pressure 52 to penetrate between the detritus 64 and side surface 14 proximate the cutting edge of diamond table 12 and act beneficially to lift the detritus 64 away from the side surface 14, inhibiting buildup. The PFC model tests shown in FIGS. 3A and 3B were repeated numerous times with different bit clearance angles 18 (the angle between the side surface 14 of the cutter 10 and the direction of cut into adjacent, underlying formation material), including tests with the clearance angle as low as 5 degrees. All tests provided consistent, repeatable results confirming the phenomenon illustrated in FIGS. 3A and 3B.

Figure 4:
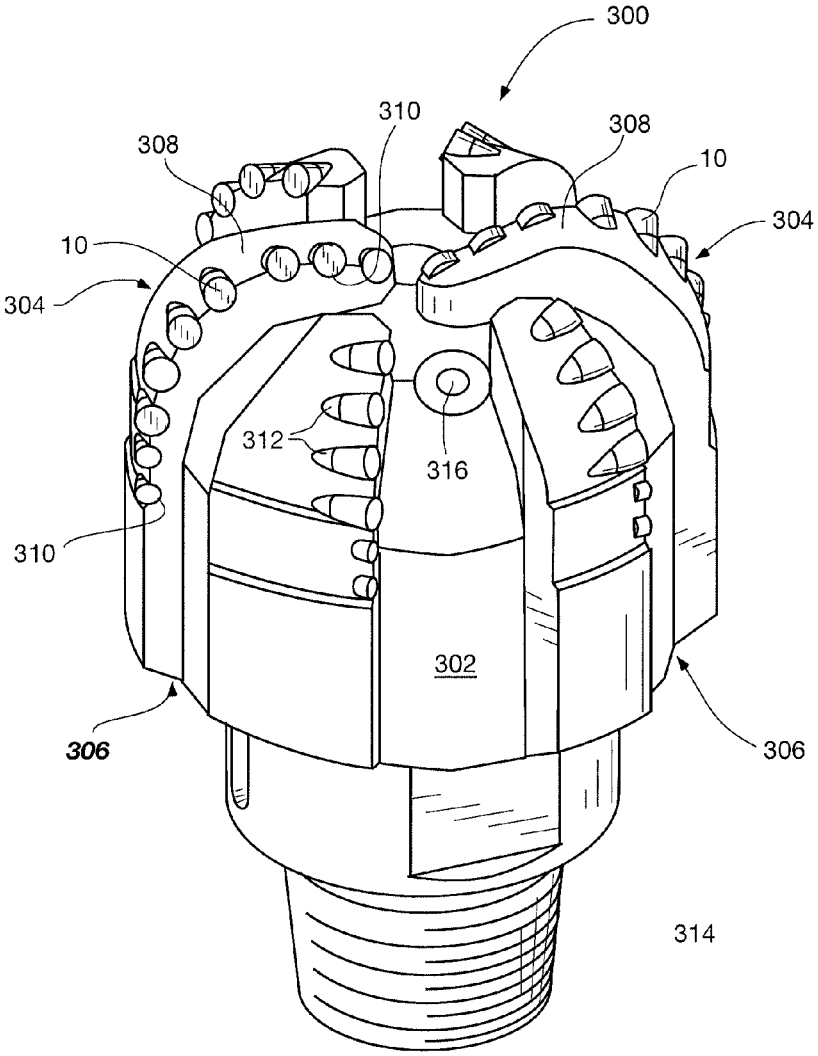
FIG. 4 depicts a conventional rotary drag bit including one embodiment of the present invention.

Referring to FIG. 4, a conventional fixed-cutter rotary drill bit 300 includes a bit body 302 that has generally radially projecting and longitudinally extending wings or blades 304, which are separated by channels and junk slots 306. A plurality of PDC cutters 10 is provided on the leading faces of the blades 304 extending over the face 308 of the bit body 302. The face 308 of the bit body 302 includes the surfaces of the blades 304 that are configured to engage the formation being drilled, as well as the exterior surfaces of the bit body 302 within the channels and junk slots 306. The plurality of PDC cutters 10 may be provided along each of the blades 304 within pockets 310 formed in the blades 304, and may be supported from behind by buttresses 312, which may be integrally formed with the bit body 302.

The drill bit 300 may further include an API threaded connection portion 314 for attaching the drill bit 300 to a drill string (not shown). Furthermore, a longitudinal bore (not shown) extends longitudinally through at least a portion of the bit body 302, and internal fluid passageways (not shown) provide fluid communication between the longitudinal bore and nozzles 316 provided at the face 308 of the bit body 302 and opening onto the channels leading to junk slots 306.

During drilling operations, the drill bit 300 is positioned at the bottom of a well borehole and rotated while weight-on-bit is applied and drilling fluid is pumped through the longitudinal bore, the internal fluid passageways, and the nozzles 316 to the face 308 of the bit body 302. As the drill bit 300 is rotated, the PDC cutters 10 scrape across, and shear away, the underlying earth formation. The formation cuttings mix with, and are suspended within, the drilling fluid and pass through the junk slots 306 and up through an annular space between the wall of the borehole and the outer surface of the drill string to the surface of the earth formation.

The inventor contemplates that embodiments of the cutter of the invention will be used on rotary drag bits as described above and include without limitation core bits, bi-center bits, and eccentric bits, as well as on fixed-cutter drilling tools of any configuration including, without limitation, reamers or other hole opening tools. Accordingly, the terms "rotary drag bit" and "apparatus for subterranean drilling" as used herein encompasses all such apparatus.

Each of FIGS. 5A-5E is a partial section view of an embodiment of a cutter according to the present invention, each cutter embodiment including a cutter barrel 110 comprising a supporting substrate having a PDC table 112 formed thereon and a side surface 114 which, when the cutter is positioned on a rotary drag bit, is adjacent to the formation being cut.

Figure 5A:
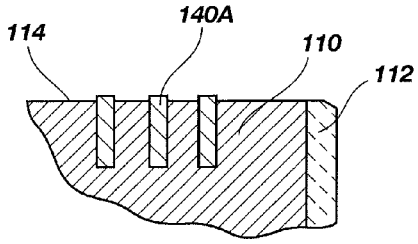
FIG. 5A is a section view of a cutter barrel assembly including structures disposed in sockets formed in a bottom surface.

FIG. 5A is a partial section view including structures 140A disposed in sockets formed in, or disposed on, the side surface 114 of cutter barrel 110. The structures 140A may be configured as bars, discs, triangles, cubes or rods, which are welded, brazed or cemented into reciprocal sockets formed in the side surface 114. The structures 140A may be formed using a hard, erosion- and abrasion-resistant material such as tungsten carbide, PDC or TSP. Structures 140A will increase friction between the detritus cut from the formation and the side surface 114.

Figure 5B:
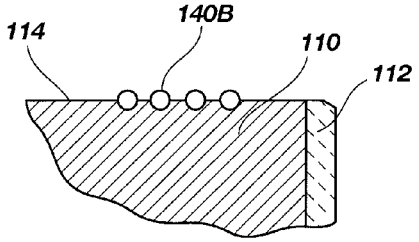
FIG. 5B is a section view of a cutter barrel assembly including balls or cylinders attached to a bottom surface.

FIG. 5B depicts balls or cylinders 140B secured to the side surface 114 of cutter barrel 110. The balls or cylinders 140B will increase friction between the side surface 114 and the detritus. The cylinders or balls 140B may be cemented, welded or brazed directly on the side surface 114, or may be secured in sockets formed in the side surface 114. The balls or cylinders 140B may comprise a wear-resistant material such as tungsten carbide, PDC or TSP.

Figure 5C:
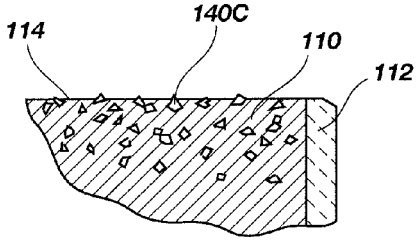
FIG. 5C is a section view of a cutter barrel assembly including abrasive particles interstitial with the cutter barrel assembly.

FIG. 5C depicts abrasive particles 140C carried on side surface 114 of cutter barrel 110. The abrasive particles 140C can be tungsten carbide, natural diamond, or synthetic diamond. The abrasive particles 140C may be cemented, welded or brazed on the side surface 114 or the abrasive particles 140C may be cast or otherwise incorporated directly into the material of cutter barrel 110. The abrasive particles 140C may also be formed into an insert by a process such as casting or sintering. The insert can then be disposed in a complementary receptacle in side surface 114. Embodiments where the abrasive particles 140C are integral with the side surface 114 provide an additional advantage in that, as the side surface 114 wears, new abrasive particles will be exposed. Further, it is known in the art to coat diamond grit with a single layer of metal, or multiple layers, which coatings may be used to bond the aforementioned natural or synthetic diamond particles to side surface 114, or integrally with the material (conventionally tungsten carbide) of cutter barrel 110 during formation thereof.

Figure 5D:
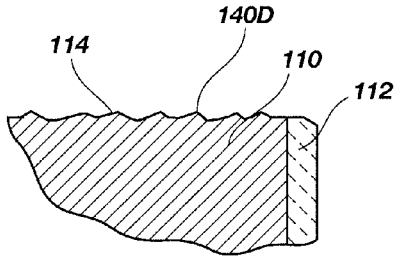
FIG. 5D is a section view of a cutter barrel assembly where a bottom surface includes a texture or has been roughened.

The section of side surface 114 of cutter barrel 110 shown in FIG. 5D includes a textured or patterned topography or has been roughened, at 140D, to provide an irregular surface. The texture 140D can be cast, milled, or cut into the side surface 114 and may comprise ridges, grooves, cross-hatching, bumps, divots, dimples or holes. Roughening can be achieved by sandblasting, beadblasting, shot-peening, or by welding a hardfacing material to the side surface 114.

As will be readily appreciated by those of ordinary skill in the art, the foregoing embodiments, which may be said to increase frictional characteristics of the side surface 114, hinder the formation of the previously-described obtuse angle between detritus and the side surface 114, maintaining access of hydrostatic pressure to the area therebetween.

Figure 5E:
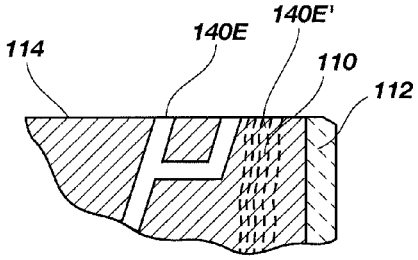
FIG. 5E is a section view of a cutter barrel assembly where holes or nozzles, in communication with pressurized drilling fluid filtrate, are disposed on a bottom surface.

FIG. 5E is a partial section view of the side surface 114 of cutter barrel 110 including holes or apertures 140E opening thereonto. High pressure filtrate in the form of drilling fluid under ambient pressure communicating through the holes or apertures 140E will equalize pressure with that tending to press detritus against side surface 114, largely prevent detritus buildup on the side surface 114 and break away any significant deposit that begins to form. In lieu of the relatively large holes or apertures 140E, a portion of cutter barrel 110 may be formed to be substantially porous or permeable, as illustrated by broken lines 140E', or a porous insert (such as a porous, sintered body) may be disposed in a recess in the cutter barrel 110, to provide access by high pressure drilling fluid from the drill bit interior to side surface 114.

The foregoing embodiments may be described as hindering differential sticking by allowing hydrostatic pressure in the vicinity of the cutter barrel 10 to communicate into the area between the side surface 114 and proximate detritus.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A cutting element for use in subterranean drilling, the cutting element comprising, as manufactured and prior to use in subterranean drilling:

a cutter barrel comprising a supporting substrate having a superabrasive table directly secured to an end thereof; and a side surface on the cutter barrel and extending longitudinally away from a cutting edge of the superabrasive table, the side surface comprising at least one flow management feature positioned on a substrate portion of the side surface longitudinally adjacent to a diamond table portion of the side surface and configured to lift rock detritus cut by an edge of the superabrasive table from a subterranean formation away from the side surface of the cutter barrel extending substantially to the cutting edge to enable the cutting edge to directly contact subterranean formation rock by substantially equalizing, when the cutting element is used for subterranean drilling of a wellbore, hydrostatic pressure of drilling fluid immediately adjacent to the supporting substrate portion of the side surface and the superabrasive table portion of the side surface and ambient hydrostatic drilling fluid pressure in the wellbore.

2. The cutting element of claim 1, wherein the at least one flow management feature further comprises a roughened portion of the supporting substrate portion of the side surface.

3. The cutting element of claim 1, wherein at least one flow management feature further comprises wear-resistant particles integral with the supporting substrate portion of the side surface.

4. The cutting element of claim 3, wherein the wear-resistant particles comprise at least one of tungsten carbide, diamond, polycrystalline diamond and thermally stable polycrystalline diamond.

5. The cutting element of claim 1, wherein the at least one flow management feature comprises diamond particles in a tungsten carbide matrix on the supporting substrate portion of the side surface.

6. The cutting element of claim 5, wherein the diamond particles are secured to the tungsten carbide by one of a braze material and sintering.

7. The cutting element of claim 5, wherein the diamond particles are integral with the supporting substrate.

8. The cutting element of claim 1, wherein the at least one flow management feature comprises a surface exhibiting an enhanced coefficient of friction relative to another portion of the supporting substrate portion of the side.

9. The cutting element of claim 1, wherein the at least one flow management feature comprises one or more holes configured to permit communication of hydrostatic pressure drilling fluid adjacent the cutting element with the supporting substrate portion of the side surface from the interior of the supporting substrate.

10. The cutting element of claim 1, wherein the at least one flow management feature comprises a permeable portion of the supporting substrate extending to the supporting substrate portion of the side surface.

11. An apparatus for use in subterranean drilling, the apparatus comprising:

a body having a plurality of cutting elements affixed to a face thereof for contacting a subterranean formation, wherein at least one of the plurality of cutting elements comprises, as manufactured and prior to use in subterranean drilling:

a cutter barrel comprising a supporting substrate having a superabrasive table directly secured to an end thereof; and a side surface on the cutter barrel extending longitudinally away from a cutting edge of the superabrasive table and comprising at least one flow management feature positioned on a substrate portion of the side surface longitudinally adjacent to a diamond table portion of the side surface and configured to lift rock detritus cut by an edge of the superabrasive table from a subterranean formation away from the side surface of the cutter barrel extending substantially to the cutting edge to enable the cutting edge to directly contact subterranean formation rock by substantially equalizing, when the apparatus is used for subterranean drilling of a wellbore, hydrostatic pressure of drilling fluid immediately adjacent to the supporting substrate portion of the side surface and the superabrasive table portion of the side surface and ambient hydrostatic drilling fluid pressure in the wellbore.

12. The apparatus of claim 11, wherein the at least one flow management feature of the cutter barrel further comprises a roughened portion of the supporting substrate portion of the side surface.

13. The apparatus of claim 11, wherein the at least one flow management feature further comprises wear-resistant particles integral with the supporting substrate portion of the side surface.

14. The apparatus of claim 13, wherein the wear-resistant particles comprise at least one of tungsten carbide, diamond, polycrystalline diamond and thermally stable polycrystalline diamond.

15. The apparatus of claim 11, wherein the at least one flow management feature comprises diamond particles in a tungsten carbide matrix on the supporting substrate portion of the side surface.

16. The apparatus of claim 15, wherein the diamond particles are secured to the tungsten carbide by one of a braze material and sintering.

17. The apparatus of claim 15, wherein the diamond particles are integral with the supporting substrate portion of the side surface.

18. The apparatus of claim 11, wherein the at least one flow management feature comprises a surface exhibiting an enhanced coefficient of friction relative to another portion of the supporting substrate portion of the side surface.

19. The apparatus of claim 11, wherein the at least one flow management feature comprises one or more holes configured to permit communication of hydrostatic pressure drilling fluid adjacent the cutting element with the supporting substrate portion of the side surface from the interior of the supporting substrate.

20. The apparatus of claim 11, wherein the at least one flow management feature comprises a permeable portion of the supporting substrate extending to the supporting substrate portion of the side surface.

* * * * *

UNITED STATES PATENT AND TRADEMARK OFFICE

CERTIFICATE OF CORRECTION

PATENT NO. : 9,045,955 B2
APPLICATION NO. : 13/197554
DATED : June 2, 2015
INVENTOR(S) : Leroy W. Ledgerwood, III It is certified that error appears in the above-identified patent and that said Letters Patent is hereby corrected as shown below:

In the specification:

COLUMN 5, LINE 7, change "cutter 1210" to --cutter 10--

Signed and Sealed this
Twenty-second Day of December, 2015

Michelle K. Lee

Michelle K. Lee
*Director of the United States Patent and Trademark Office*